US008542557B2

(12) United States Patent
Oh

(10) Patent No.: US 8,542,557 B2
(45) Date of Patent: Sep. 24, 2013

(54) BEFORE/AFTER SPECIFIC WEEKDAY DETERMINATION DEVICE, PROGRAM MEDIA, METHOD, DAYLIGHT SAVING TIME DETERMINATION DEVICE, AND TIMEPIECE

(75) Inventor: Jaekwan Oh, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 521 days.

(21) Appl. No.: 12/869,405

(22) Filed: Aug. 26, 2010

(65) Prior Publication Data

US 2011/0051559 A1 Mar. 3, 2011

(30) Foreign Application Priority Data

Aug. 28, 2009 (JP) ..... 2009-198647

(51) Int. Cl.
*G04B 19/22* (2006.01)
*G04C 17/00* (2006.01)
*G04C 11/00* (2006.01)

(52) U.S. Cl.
USPC ..... 368/21; 368/29; 368/47

(58) Field of Classification Search
USPC ..... 368/10, 21, 28, 29, 187, 47
See application file for complete search history.

(56) References Cited

U.S. PATENT DOCUMENTS

| | | | | |
|---|---|---|---|---|
| 4,274,146 | A * | 6/1981 | Yanagawa | 708/112 |
| 4,573,127 | A | 2/1986 | Korff | |
| 4,852,030 | A * | 7/1989 | Munday | 702/178 |
| 4,956,826 | A * | 9/1990 | Coyman et al. | 368/28 |
| 5,806,063 | A * | 9/1998 | Dickens | 1/1 |
| 6,215,862 | B1 * | 4/2001 | Lopes | 379/110.01 |
| 6,999,380 | B2 * | 2/2006 | Yamamoto | 368/10 |
| 7,701,805 | B2 * | 4/2010 | Irino | 368/21 |

FOREIGN PATENT DOCUMENTS

| | | |
|---|---|---|
| JP | 09-297191 | 11/1997 |
| SU | 1262445 A1 | 10/1986 |

* cited by examiner

*Primary Examiner* — Vit W Miska

(57) ABSTRACT

A before/after specific weekday determination device that determines if an evaluation date is before or after a specific date that is identified as an n-th (where n is an integer of 1 or more) specific weekday from the beginning or the end of a specific month. The before/after specific weekday determination device is utilized in a daylight saving time determination device, and in a timepiece.

3 Claims, 7 Drawing Sheets

| COUNTRY | TIME ZONE | LOCATION INFORMATION | TIME DIFFER-ENCE | DAYLIGHT SAVING TIME NUMBER |
|---|---|---|---|---|
| ENGLAND | WESTERN EUROPE | ··· | 0 | 1 |
| FRANCE | CENTRAL EUROPE | ··· | +1 | 2 |
| | | | | |
| | | | | |
| JAPAN | JST | ··· | +9 | 0 |
| | | | | |
| | | | | |
| AUSTRALIA | EASTERN STANDARD TIME | ··· | +10 | 4 |
| AUSTRALIA | EASTERN STANDARD TIME | ··· | +10 | 0 |
| | | | | |
| | | | | |
| AMERICA | PACIFIC STANDARD TIME | ··· | −8 | 5 |
| | | | | |
| | | | | |
| AMERICA | EASTERN STANDARD TIME | ··· | −5 | 5 |
| | | | | |
| | | | | |

52

FIG. 6

| DAYLIGHT SAVING TIME NUMBER | START TIME | END TIME | DAYLIGHT SAVING TIME ADJUSTMENT | APPLY CONDITION |
|---|---|---|---|---|
| 0 | | | 00:00 | 0 |
| 1 | 3、25、31、SUNDAY、01:00 | 10、25、31、SUNDAY、01:00 | 01:00 | 0 |
| 2 | 3、25、31、SUNDAY、02:00 | 10、25、31、SUNDAY、02:00 | 01:00 | 0 |
| 3 | 3、27、27、NONE、22:00 | 9、27、27、NONE、23:00 | 01:00 | 0 |
| 4 | 4、1、7、SUNDAY、02:00 | 10、1、7、SUNDAY、02:00 | 01:00 | 1 |
| 5 | 3、8、14、SUNDAY、02:00 | 11、1、7、SUNDAY、01:00 | 01:00 | 0 |
| | | | | |
| | | | | |
| | | | | |
| | | | | |
| | | | | |

56

FIG. 7

BEFORE/AFTER SPECIFIC WEEKDAY DETERMINATION DEVICE, PROGRAM MEDIA, METHOD, DAYLIGHT SAVING TIME DETERMINATION DEVICE, AND TIMEPIECE

CROSS-REFERENCE TO RELATED APPLICATION(S)

Japanese Patent Application No. 2009-198647, filed Aug. 28, 2009, is hereby incorporated by reference in its entirety.

BACKGROUND

1. Field of Invention

The present invention relates to a before/after specific weekday determination device, a before/after specific weekday determination computer-executable program stored on a computer readable medium, a before/after specific weekday determination method, a specific date data structure, a daylight saving time determination device, and a timepiece.

2. Description of Related Art

The Global Positioning System (GPS), which can be used to determine one's location, uses GPS satellites that orbit the Earth on known orbits with each GPS satellite having an on-board atomic clock. As a result, GPS satellites also transmit extremely accurate time information (referred to herein as GPS time or satellite time information).

Automatic correction devices that use the satellite signals transmitted from such GPS satellites to acquire positioning information and time information, determine the time zone of the current location from the acquired positioning information, and calculate and display the time at the current location are known from the literature. See, for example, Japanese Unexamined Patent Appl. Pub. JP-A-H09-297191.

More specifically, the device taught in JP-A-H09-297191 receives satellite signals and acquires the coordinates of the current location, compares these coordinates with the time zone coordinates previously stored in ROM, for example, and calculates the time difference at the current location. It then compares the coordinates with the coordinates previously stored in ROM, for example, for regions that also use daylight saving time (also known as "summer time") to determine if the current location is in a time zone that uses daylight saving time. If daylight saving time is used, it checks if an internal calendar currently indicates a date in a daylight saving time period, and if daylight saving time is in effect calculates the time adjustment from standard time. The device then automatically adjusts the time based on the calculated time difference and the daylight saving time adjustment.

In addition to determining the time zone at the current location and automatically adjusting for the time difference, the device taught in JP-A-H09-297191 can also automatically adjust the time for daylight saving time if the daylight saving time is used at the current location and the date is within the daylight saving time period, and is therefore extremely convenient.

A problem with the device taught in JP-A-H09-297191, however, is that relies on an internal calendar to determine if daylight saving time (summer time) is in effect, and therefore cannot be used in a device that does not have an internal calendar. More particularly, small devices such as wristwatches commonly have limited memory and storage capacity, and may therefore not be able to store an internal calendar. As a result, automatically adjusting the time to also reflect daylight saving time as described above may not be possible in such small devices.

Methods of using a calculation process to determine if daylight saving time is in effect instead of using an internal calendar are also conceivable.

More specifically, the beginning and end conditions for daylight saving time are typically defined as a specific weekday, such as the n-th specific weekday (where n is an integer or 1 or more) from the beginning or end of a specific month, such as the "second Sunday in March, 0:00h" or the "last Sunday in March, 0:00h," and the dates on which daylight saving time starts and ends change from year to year. Therefore, in order to determine if daylight saving time is currently in effect, it is necessary to determine the first Sunday of the month and determine the date of, for example, the second Sunday.

One method of calculating what day of the week a certain date falls on from the year, month, and day of the Western calendar uses Zeller's congruence as shown in equation (1).

$$h = \left(q + \left[\frac{(m+1)\times 26}{10}\right] + K + \left[\frac{K}{4}\right] + \left[\frac{J}{4}\right] - 2J\right) \bmod 7 \tag{1}$$

where h: is the day of the week (0=Saturday, 1=Sunday, 2=Monday, . . . 6=Friday)

q: is the day of the month m: is the month

J: is the century (year/100, throw away the decimal)

K: is the year of the century (year mod 100 (the remainder of year/100).

In addition, if the month of the desired day is January or February, January and February are counted as months 13 and 14 of the previous year. Note, further, that [x] denotes the maximum integer not exceeding x (less than or equal to x).

Another method that does not use Zeller's congruence calculates the number of days to the current date from a reference date for which the weekday is known, and calculates the (number of days mod 7) to get the remainder and determine the weekday.

However, in order to implement either of these methods in an electronic device such as a wristwatch that has only minimal processor capacity and does not have a multiplier/divider, multiplication and division operations must be handled by an adder/subtracter, resulting in a larger program and longer processing time. As a result, implementing the foregoing methods that use calculations to determine if daylight saving time is in effect is difficult in a wristwatch or other electronic device with little processor capacity and little capacity in the ROM that stores the programs.

This problem is not limited, however, to processes for determining if daylight saving time is in effect, and also occurs when it is necessary to compare a specific date that is identified as a specific n-th weekday (where n is an integer of 1 or more) from the beginning or end of a specific month, such as a specific date identified as the second Sunday of March or the last Sunday in October, with an evaluation date such as the current date and time, and determine if the evaluation date is before or after the specific date.

SUMMARY OF INVENTION

The present invention relates to a device, a program stored on a computer-readable medium, and a method enabling quickly determining if an evaluation date is before or after a specific date and reducing the size of the program in an electronic device that does not have an internal calendar or a computing device such as a multiplier and divider. The invention also relates to a a daylight saving time determination device, and a timepiece.

A first aspect of the invention is a before/after specific weekday determination device that determines if an evaluation date is before or after a specific date that is identified as an n-th (where n is an integer of 1 or more) specific weekday from the beginning or the end of a specific month, including: an evaluation date input unit that inputs a number M1 denoting the month, a number D1 denoting the day, and weekday DW1 of the evaluation date; a specific date data storage that stores numbers M0 denoting the month of the specific date, weekdays DW0, a number DS denoting a first candidate date that is the first of the seven candidate dates that could be the specific date in the month M0, and a number DE denoting the candidate date that is last in the same group of candidate dates (last candidate date); and a decision unit that compares data input by the evaluation date input unit with data stored in the specific date data storage, and decides if the input evaluation date is before or after the specific date. The decision unit determines that the evaluation date is before the specific date when M1 is less than M0, when M1 is equal to M0 and D1 is less than DS, and when M1 is equal to M0, D1 is greater than or equal to DS and less than or equal to DE, DW1 and DW0 are different, and the number of days Nd from first candidate date DS to the evaluation date D1 is less than the number of weekdays Ndw from the weekday DW0 of the specific date to the weekday DW1 of the evaluation date; and determines the evaluation date is after the specific date when M1 is greater than M0, when M1 is equal to M0 and D1 is greater than DE, and when M1 is equal to M0, D1 is greater than or equal to DS and less than or equal to DE, DW1 and DW0 are different, and the number of days Nd from first candidate date DS to the evaluation date D1 is greater than or equal to the number of weekdays Ndw from the weekday DW0 of the specific date to the weekday DW1 of the evaluation date.

The evaluation conditions of the decision unit can be summarized as shown below where conditions 1 to 3 are the conditions under which the evaluation date is before the specific date, and conditions 4 to 6 are the conditions for determining that the evaluation date is after the specific date.

*Conditions Determining that the Evaluation Date is Before the Specific Date $M1<M0$ — Condition 1

$M1=M0$ and $D1<DS$ — Condition 2

$M1=M0$ and $DS\leq D1\leq DE$ and $DW1\neq DW0$ and $Nd\leq Ndw$ — Condition 3

*Conditions Determining that the Evaluation Date is after the Specific Date $M1>M0$ — Condition 4

$M1=M0$ and $D1>DE$ — Condition 5

$M1=M0$ and $DS\leq D1\leq DE$ and $DW1\neq DW0$ and $Nd\geq Ndw$ — Condition 6 where

M1: is a number denoting the month of the evaluation date

D1: is a number denoting the day of the evaluation date

DW1: is the weekday of the evaluation date

M0: is a number denoting the month of the specific date

DW0: is the weekday of the specific date

DS: is a number denoting the earliest candidate date (first candidate date) selected from the 7 candidate dates that could be the specific date DE: is a number denoting the final candidate date (last candidate date) selected from the possible candidate dates Nd: is the number of days from the first candidate date DS to the evaluation date D1

Ndw: is the number of weekdays from weekday DW0 of the specific date to weekday DW1 of the evaluation date A specific date that is identified as an n-th (where n is an integer of 1 or more) specific weekday from the beginning or the end of a specific month indicates a day (such as the second Sunday in March) that is identified as the n-th (such as the 2nd) specific weekday (such as Sunday) from the beginning of a specific month (such as March), or a day (such as the last Sunday in March) that is identified as the n-th (such as the 1st) specific weekday (such as Sunday) from the end of a specific month (such as March).

When a reception unit for receiving GPS satellite signals is provided, the evaluation date input unit may input the received time information (month, date, hour, minute, weekday) to the before/after specific weekday determination device. If a timekeeping unit is used to keep the internal time, the evaluation date input unit may input the kept time information to the decision unit. If buttons or other operating devices are disposed to the before/after specific weekday determination device, the evaluation date input unit may input time information input by the user to the decision unit. If, for example, 3/10 (Wednesday) is input as the evaluation date, the evaluation date input unit may input M1 (month of the evaluation date)=3, D1 (day of the evaluation date)=10, and DW1 (weekday of the evaluation date)=Wednesday.

The specific date data storage is a RAM device or other type of memory device that stores the specific date data. For example, if the specific date is the second Sunday in March, the dates that could be this specific date are the seven days from 3/8 to 3/14. Therefore, M0 (the month of the specific date)=3, DW0 (the weekday of the specific date)=Sunday, DS (first candidate date)=8, and DE (last candidate date)=14 are stored as the specific date information in the specific date data storage.

In the invention the decision unit compares the month M1 of the evaluation date with the month M0 of the specific date, determines the evaluation date is after the specific date if M1>M0, and before the specific date if M1<M0. More specifically, because M1 and M0 are both numbers representing months, if the month M0 of the specific date is hands 3, an evaluation date of month M1=4-12 (a day in months April to December) will be after the specific date. Likewise, if the month of the evaluation date M1=1 or 2, the evaluation date (a day in January or February) will be before the specific date.

Furthermore, if M1=M0 and evaluation date D1 is greater than last candidate date DE, the decision unit determines the evaluation date is after the specific date. For example, if last candidate date DE=14 (3/14), an evaluation date D1=15-31 (3/15-31) will be after the specific date.

In addition, if M1=M0 and the evaluation date D1 is less than first candidate date DS, the decision unit determines the evaluation date is before the specific date. For example, if first candidate date DS=8 (3/8), an evaluation date D1=1-7 (3/1-7) is before the specific date.

Furthermore, if the month of the evaluation date M1=the month M0 of the specific date, and the day D1 of the evaluation date is greater than or equal to first candidate date DS and is less than or equal to last candidate date DE, and the weekday DW1 of the evaluation date and the weekday DW0 of the specific date are different (the days of the week are different), the decision unit determines the number of days Nd from the first candidate date DS to the evaluation date D1, and the number of weekdays Ndw from the weekday DW0 of the specific date to the weekday DW1 of the evaluation date.

Calculating the number of days Nd and the number of weekdays Ndw is described below where the specific date is the second Sunday in March, and the evaluation date is 3/10 (Monday).

The days that could be the second Sunday in March are 3/8 (when 3/1 is a Sunday) to 3/14 (when 3/7 is a Sunday). As a result, the first candidate date DS=8.

The number of days Nd from first candidate date DS=8 to the evaluation date D1=10 is therefore 2 because adding two days to 3/8 equals 3/10. This can be determined by subtracting the number 8 of the first candidate date DS (=8) from the number 10 of the evaluation date D1 (=10). More specifically, in this example the number of days Nd=10−8=2.

The number of weekdays Ndw is the number of days from weekday DW0 to weekday DW1 of the evaluation date based on the weekday DW0 of the specific date. For example, if weekday DW0 is Sunday and weekday DW1 is Monday, Monday is reached by adding one day to Sunday, and the number of weekdays Ndw=1.

Likewise, if weekday DW0 is Sunday and weekday DW1 is Saturday, Saturday is reached six days after Sunday, and the number of weekdays Ndw=6. Because weekday DW0 is Sunday and weekday DW1 is Monday in this example, the number of weekdays Ndw=1.

In the foregoing example, therefore, the number of days Nd is 2 and is therefore greater than the number of weekdays Ndw=1, and the evaluation date is after the specific date. Thus, if the evaluation date is 3/10 (Monday), it can be confirmed to be after the specific date because the second Sunday in March is 3/9 (Sunday).

An example in which the specific date is the second Sunday in March and the evaluation date is 3/10 (Wednesday) is described next. Because the first candidate date DS is 8 in this example, the number of days Nd is 10−8=2. In addition, the number of weekdays Ndw=3 because adding three days to Sunday gets Wednesday.

Therefore, when the evaluation date is 3/10 (Wednesday), the number of days Nd is 2 and is less than the number of weekdays Ndw 3, and the evaluation date is before the specific date. This can also be proved because if the evaluation date is 3/10 (Wednesday), the second Sunday in March is 3/14 (Sunday), and is before the specific date.

Because whether or not the evaluation date is before or after a specific date can be determined by comparing the size of the data values in this aspect of the invention, the size of the program can be reduced compared with a program that substitutes multiplication and division operations with addition and subtraction processes. As a result, the process can be executed and processing time can be shortened even in an electronic device such as a wristwatch that does not have multiplication and division functions and has only limited processing capacity and memory capacity.

The invention can also be used in a device with limited memory capacity because a specific date identified as a day of the week can be compared with an evaluation date even without an internal calendar. Whether an evaluation date is before or after a specific date can therefore be determined quickly even in an electronic device such as a wristwatch with small ROM capacity and little processor power. Furthermore, because the foregoing determination is possible, whether the current time is within a period, such as daylight saving time, of which the first and last days are generally identified by the day of the week is possible, whether daylight saving time is in effect can be determined even in a wristwatch, and the time can be automatically adjusted to daylight saving time.

In a before/after specific weekday determination device according to another aspect of the invention, the evaluation date input unit also inputs hour-minute Hm1 denoting the hour and minute of the evaluation time of the evaluation date; the specific date data storage stores hour-minute Hm0 denoting the hour and minute of the evaluation time of the specific date; and the decision unit determines that the evaluation date is before the specific date when the month M1 of the evaluation date and month M0 of the specific date are equal, day D1 of the evaluation date is greater than or equal to first candidate date DS and less than or equal to last candidate date DE, weekday DW1 of the evaluation date and weekday DW0 of the specific date are equal, and the hour-minute Hm1 is before hour-minute Hm0, and determines that the evaluation date is after the specific date when the month M1 of the evaluation date and month M0 of the specific date are equal, day D1 of the evaluation date is greater than or equal to first candidate date DS and less than or equal to last candidate date DE, weekday DW1 of the evaluation date and weekday DW0 of the specific date are equal, and the hour-minute Hm1 is after hour-minute Hm0.

Evaluation conditions used by the decision unit that also consider time (hour and minute) can be summarized as follows where the condition for determining the evaluation date is before the specific date is condition 7, and the condition for determining the evaluation date is before the specific date is condition 8.

*Condition for Determining the Evaluation Date is Before the Specific Date Based on Time $$M1=M0 \text{ and } DS \le D1 \le DE \text{ and } DW1=DW0 \text{ and } Hm1<Hm0 \qquad \text{Condition 7}$$

*Condition for Determining the Evaluation Date is after the Specific Date Based on Time $$M1=M0 \text{ and } DS \le D1 \le DE \text{ and } DW1=DW0 \text{ and } Hm1>Hm0 \qquad \text{Condition 8}$$

where Hm1 is the hour and minute of the evaluation time of the evaluation date, and Hm0 is the hour and minute of the evaluation time of the specific date.

When the month M1 of the evaluation date and the month M0 of the specific date are equal, and the day of the evaluation date D1 is greater than or equal to the first candidate date DS and is less than or equal to last candidate date DE, and the weekday DW1 of the evaluation date and the weekday DW0 of the specific date are equal, that is, the evaluation date and the specific date are the same day, the foregoing aspect of the invention cannot determine if the evaluation date is before or after the specific date.

However, when the start time and the end time of the specific date are specified by the hour and minute in addition to the day, such as daylight saving time, determining whether it is before or after the specific date is necessary even if the days are the same. In this situation, the hour-minute Hm0 of the evaluation time of the specific date is also stored in the specific date data storage, the hour-minute Hm1 of the evaluation time of the evaluation date is input, and which time is earlier can be determined.

For example, if the specific date is 1:00 a.m on the second Sunday in March, and the evaluation date is 3/8 (Sunday), and the same second Sunday, the evaluation date is before the specific date if the hour-minute Hm1 is 0:00-0:59, and is after the specific date if the hour-minute Hm1 is 1:01-23:59. Note that what the process does if hour-minute Hm1=hour-minute Hm0 can be configured according to the purpose of comparing the evaluation date and specific date.

Because this aspect of the invention compares the evaluation date and specific date based on time when the date and weekday thereof are the same, whether the evaluation date is before or after the specific date can be determined.

Another aspect of the invention is a tangible computer-readable medium containing a before/after specific weekday determination program of instructions executable by a computer to determine if an evaluation date is before or after a specific date that is identified as an n-th, where n is an integer of 1 or more, specific weekday from the beginning or the end of a specific month, whereby the computer executes the program of instructions to: input a number M1 denoting the month, a number D1 denoting the day, and weekday DW1 of the evaluation date; store numbers M0 denoting the month of the specific date, weekdays DW0, a number DS denoting a first candidate date that is the first of the seven candidate dates that could be the specific date in the month M0, and a number DE denoting an end candidate date that is the last candidate date; and compare the numbers input with the numbers stored, and determine that the evaluation date is before the specific date when M1 is less than M0, when M1 is equal to M0 and D1 is less than DS, and when M1 is equal to M0, D1 is greater than or equal to DS and less than or equal to DE, DW1 and DW0 are different, and the number of days Nd from first candidate date DS to the evaluation date D1 is less than the number of weekdays Ndw from the weekday DW0 of the specific date to the weekday DW1 of the evaluation date; and determine that the evaluation date is after the specific date when M1 is greater than M0, when M1 is equal to M0 and D1 is greater than DE, and when M1 is equal to M0, D1 is greater than or equal to DS and less than or equal to DE, DW1 and DW0 are different, and the number of days Nd from first candidate date DS to the evaluation date D1 is greater than or equal to the number of weekdays Ndw from the weekday DW0 of the specific date to the weekday DW1 of the evaluation date.

The conditions used in this before/after specific weekday determination program to decide if the evaluation date is before the specific date are conditions 1 to 3 described above, and the conditions used to decide if the evaluation date is after the specific date are the conditions 4 to 6 described above.

This aspect of the invention has the same operational effect as the before/after specific weekday determination device described above.

Furthermore, because the size of this program can be made smaller than a program that substitutes addition and subtraction operations for multiplication and division, and can shorten the processing time, the program can be used in a timepiece that has limited memory capacity in ROM, for example, and uses a 4-bit CPU, for example, with little processing power.

Further preferably in this program, the computer also inputs hour-minute Hm1 representing the hour and minute of the evaluation time of the evaluation date, and stores hour-minute Hm0 information representing the hour and minute of the evaluation time of the specific date, and determines that the evaluation date is before the specific date if M1 and M0 are equal, D1 is greater than or equal to DS and less than or equal to DE, DW1 and DW0 are equal, and the hour-minute Hm1 is before the hour-minute Hm0, and determines the evaluation date is after the specific date if hour-minute Hm1 is after hour-minute Hm0. In other words, the condition for determining the evaluation date is before the specific date is condition 7 above, and the condition for determining the evaluation date is after the specific date is condition 8.

Because this aspect of the invention compares the evaluation date and specific date based on time when the date and weekday thereof are the same, whether the evaluation date is before or after the specific date can be determined.

Another aspect of the invention is a before/after specific weekday determination method that determines if an evaluation date is before or after a specific date that is identified as an n-th (where n is an integer of 1 or more) specific weekday from the beginning or the end of a specific month, including: inputting a number M1 denoting the month, a number D1 denoting the day, and weekday DW1 of the evaluation date; storing in advance numbers M0 denoting the month of the specific date, weekdays DW0, a number DS denoting a first candidate date that is the first of the seven candidate dates that could be the specific date in the month M0, and a number DE denoting an end candidate date that is the last candidate date; and comparing the numbers with the numbers stored, and determining if the input evaluation date is before or after the specific date; wherein the evaluation date is determined to be before the specific date when M1 is less than M0, when M1 is equal to M0 and D1 is less than DS, and when M1 is equal to M0, D1 is greater than or equal to DS and less than or equal to DE, DW1 and DW0 are different, and the number of days Nd from first candidate date DS to the evaluation date D1 is less than the number of weekdays Ndw from the weekday DW0 of the specific date to the weekday DW1 of the evaluation date; and the evaluation date is determined to be after the specific date when M1 is greater than M0, when M1 is equal to M0 and D1 is greater than DE, and when M1 is equal to M0, D1 is greater than or equal to DS and less than or equal to DE, DW1 and DW0 are different, and the number of days Nd from first candidate date DS to the evaluation date D1 is greater than or equal to the number of weekdays Ndw from the weekday DW0 of the specific date to the weekday DW1 of the evaluation date.

The conditions used in this before/after specific weekday determination method to decide if the evaluation date is before the specific date are conditions 1 to 3 described above, and the conditions used to decide if the evaluation date is after the specific date are the conditions 4 to 6 described above.

This aspect of the invention has the same operational effect as the before/after specific weekday determination device described above.

Further preferably in this method, hour-minute Hm1 representing the hour and minute of the evaluation time of the evaluation date is input, hour-minute Hm0 information representing the hour and minute of the evaluation time of the specific date is stored, and it is determined that the evaluation date is before the specific date if M1 and M0 are equal, D1 is greater than or equal to DS and less than or equal to DE, DW1 and DW0 are equal, and the hour-minute Hm1 is before the hour-minute Hm0, and it is determined that the evaluation date is after the specific date if hour-minute Hm1 is after hour-minute Hm0. In other words, the condition for determining the evaluation date is before the specific date is condition 7 above, and the condition for determining the evaluation date is after the specific date is condition 8.

Because this aspect of the invention compares the evaluation date and specific date based on time when the date and weekday thereof are the same, whether the evaluation date is before or after the specific date can be determined.

Another aspect of the invention is a daylight saving time determination device that has the before/after specific weekday determination device described above and determines if the current time is in a period when daylight saving time is in effect, wherein: a start time that is an earlier date and an end time that is the later date from January to December for switching between daylight saving time being in effect and not in effect, a daylight saving time adjustment, and an apply condition denoting if the period from the start time to the end time is when daylight saving time is in effect or not in effect are stored in the specific date data storage; numbers M0 denoting the month of the start time and end time, weekdays DW0, a number DS denoting a first candidate date that is the first of the seven candidate dates that could be the specific date in the month M0, a number DE denoting a last candidate date that is the candidate date at the end, and hour-minute Hm0 denoting the hour and minute of the start time and end time, are stored for the start time and end time in the specific date data storage; the evaluation date input unit inputs a number M1 denoting the month of the current time, a number D1 denoting the date, weekday DW1, and hour-minute Hm1 denoting the hour and minute as the number M1 denoting the month of the evaluation date, number D1 denoting the date, weekday DW1, and hour-minute Hm1. The decision unit determines if the current time is before or after the start time using the current time as the evaluation date and the start time as the specific date, and if as a result of comparing the current time and start time the current time is determined to be after the start time, determines if the current time is before or after the end time using the current time as the evaluation date and the end time as the specific date; if the current time is determined to be before the start time, or if the current time is determined to be after the end time, determines that the current time is in the period when daylight saving time is in effect only if the apply condition is that the period from the start time to the end time is when daylight saving time is not in effect; and if the current time is determined to be after the start time and the current time is determined to be before the end time, determines that the current time is in the period when daylight saving time is in effect only if the apply condition is that the period from the start time to the end time is when daylight saving time is in effect.

More specifically, of the times for changing between when daylight saving time is in effect and when it is not in effect, the conditions for determining if the current time is after the start time and before the end time, or if the current time is before the start time and after the end time, where the start time is the earlier date between January and December and the end time is the later date, are conditions 1 to 8 below, and whether the period containing the current time is a period when daylight saving time is in effect can be determined based on the apply condition.

The following parameters are used in the following conditions 1-8 to determine if the current time is before or after the start time.

M1: a number denoting the month of the current time

D1: a number denoting the day of the current time

DW1: the weekday of the current time

Hm1: the hour and minute of the current time

M0: a number denoting the month of the start time

DW0: the weekday of the start time

Hm0: the hour and minute of the start time

DS: a number denoting the earliest candidate date (first candidate date) selected from the 7 candidate dates that could be the start time DE: a number denoting the final candidate date (last candidate date) selected from the possible candidate dates Nd: is the number of days from the first candidate date DS to the current time D1

Ndw: is the number of weekdays from weekday DW0 of the start time to weekday DW1 of the current time Likewise, to determine if the current time is before or after the end time, the following parameters are used in the following conditions 1 to 8.

M1: a number denoting the month of the current time

D1: a number denoting the day of the current time

DW1: the weekday of the current time

Hm1: the hour and minute of the current time

M0: a number denoting the month of the end time

DW0: the weekday of the end time

Hm0: the hour and minute of the end time

DS: a number denoting the earliest candidate date (first candidate date) selected from the 7 candidate dates that could be the end time DE: a number denoting the final candidate date (last candidate date) selected from the possible candidate dates Nd: is the number of days from the first candidate date DS to the current time D1

Ndw: is the number of weekdays from weekday DW0 of the end time to weekday DW1 of the current time

*Conditions for Determining if the Current Time is Before the Start Time or Before the End Time

| | |
|---|---|
| $M1<M0$ | Condition 1 |
| $M1=M0$ and $D1<DS$ | Condition 2 |
| $M1=M0$ and $DS\leq D1\leq DE$ and $DW1\neq DW0$ and $Nd<Ndw$ | Condition 3 |
| $M1=M0$ and $DS\leq D1\leq DE$ and $DW1=DW0$ and $Hm1<Hm0$ | Condition 7 |

*Conditions for Determining if the Current Time is after the Start Time or after the End Time

| | |
|---|---|
| $M1>M0$ | Condition 4 |
| $M1=M0$ and $D1>DE$ | Condition 5 |
| $M1=M0$ and $DS\leq D1\leq DE$ and $DW1\neq DW0$ and $Nd\geq Ndw$ | Condition 6 |
| $M1=M0$ and $DS\leq D1\leq DE$ and $DW1=DW0$ and $Hm1>Hm0$ | Condition 8 |

As in the before/after specific weekday determination device described above, by using the current time as the evaluation date and the start time or end time of daylight saving time as the specific date, whether the current time is before or after the start time of daylight saving time, and whether the current time is before or after the end time of daylight saving time, can be determined. This aspect of the invention can therefore determine using a process of comparing data values whether the current time is between the start time and end time, or is outside this period, and the size of the program can be reduced compared with a program that substitutes multiplication and division operations with addition and subtraction processes. As a result, the process can be executed and processing time can be shortened even in an electronic device such as a wristwatch that does not have multiplication and division functions and has only limited processing capacity and memory capacity.

Furthermore, because the start time and end time of daylight saving time, which is identified using the day of the week, can be compared with the current time as the evaluation date, the invention can also be used in a device with limited memory capacity even without an internal calendar.

Whether an evaluation date is before or after a specific date can therefore be determined quickly even in an electronic device such as a wristwatch with small ROM capacity and little processor power. Furthermore, because the foregoing determination is possible, whether the current time is within a period, such as daylight saving time, of which the first and last days are generally identified by the day of the week is possible, whether daylight saving time is in effect can be determined even in a wristwatch, and the time can be automatically adjusted to daylight saving time.

Whether or not the current time is in a period when daylight saving time is in effect can therefore be quickly determined even in an electronic device, such as a wristwatch, with little ROM capacity and low processor power. In addition, because this determination is possible, whether or not daylight saving time is in effect can be determined even in a wristwatch and the time can be automatically updated for daylight saving time.

Another aspect of the invention is a timepiece including: the daylight saving time determination device described above; a timekeeping unit that keeps current time; and a daylight saving time updating unit that adjusts the current time by the daylight saving time adjustment and updates to daylight saving time when the daylight saving time determination device determines that the current time is in a period when daylight saving time is in effect.

The timepiece according to this aspect of the invention uses the daylight saving time determination device to determine if the current time kept by the timekeeping unit is a time when daylight saving time is in effect. If daylight saving time is in effect, the daylight saving time updating unit can automatically update the current time to daylight saving time. The timepiece user therefore does not need to manually adjust the time at the start and end of daylight saving time, and convenience is greatly improved.

A timepiece according to another aspect of the invention preferably also has a reception unit that can receive satellite signals transmitted from positioning information satellites and acquire positioning information and time information; a time difference information storage unit that stores positioning information, time difference information for the positioning information, and daylight saving time pattern data corresponding to the positioning information; and a time adjustment unit that obtains the time at the current location using positioning information and time information received by the reception unit, and information stored in the time difference information storage unit, and adjusts the current time kept by the timekeeping unit. The specific date data storage stores the start time, end time, daylight saving time adjustment, and apply conditions linked to the daylight saving time pattern data. The time adjustment unit acquires time difference information for the positioning information from the time difference information storage unit, corrects the received time information by the time difference, acquires the time of the current location, and adjusts the current time kept by the timekeeping unit. The daylight saving time updating unit determines by using the daylight saving time determination unit if the current time is in a period when daylight saving time is in effect based on the current time adjusted by the time adjustment unit, and the start time, end time, daylight saving time adjustment, and apply condition identified by the daylight saving time pattern data in the specific date data storage when daylight saving time pattern data is stored for the received positioning information, and updates the current time to daylight saving time if daylight saving time is determined to be in effect at the current time.

In a timepiece according to this aspect of the invention, the reception unit receives satellite signals transmitted from positioning information satellites and acquires positioning information and time information. The time adjustment unit obtains the time at the current location using the acquired positioning information and time difference information stored in the time difference information storage unit, and adjusts the time kept by the timekeeping unit.

In addition, when daylight saving time pattern data corresponding to the positioning information is stored in the time difference information storage unit, the daylight saving time updating unit acquires information corresponding to the daylight saving time pattern data from the specific date data storage (daylight saving time data storage unit), and updates the time to daylight saving time if the current time corrected by the daylight saving time determination device is in the period when daylight saving time is in effect.

As a result, if the timepiece user travels abroad, for example, and the satellite signal reception process is executed at the destination, the timepiece can automatically determine the time difference and if daylight saving time is in effect and automatically set the correct time accordingly, and can thus greatly improve convenience.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 6 shows the structure of a time difference table in a preferred embodiment of the invention.

FIG. 7 shows the structure of a daylight saving time information table in a preferred embodiment of the invention.

DESCRIPTION OF THE PREFERRED EMBODIMENTS

A preferred embodiment of the present invention is described below with reference to the accompanying figures.

The embodiment described below is a specific preferred embodiment of the present invention and is described with some technically desirable limitations applied thereto, but the scope of the invention is not limited to the following embodiments unless it is expressly stated below that the invention is limited in some way.

*GPS Wristwatch

Figure 1:
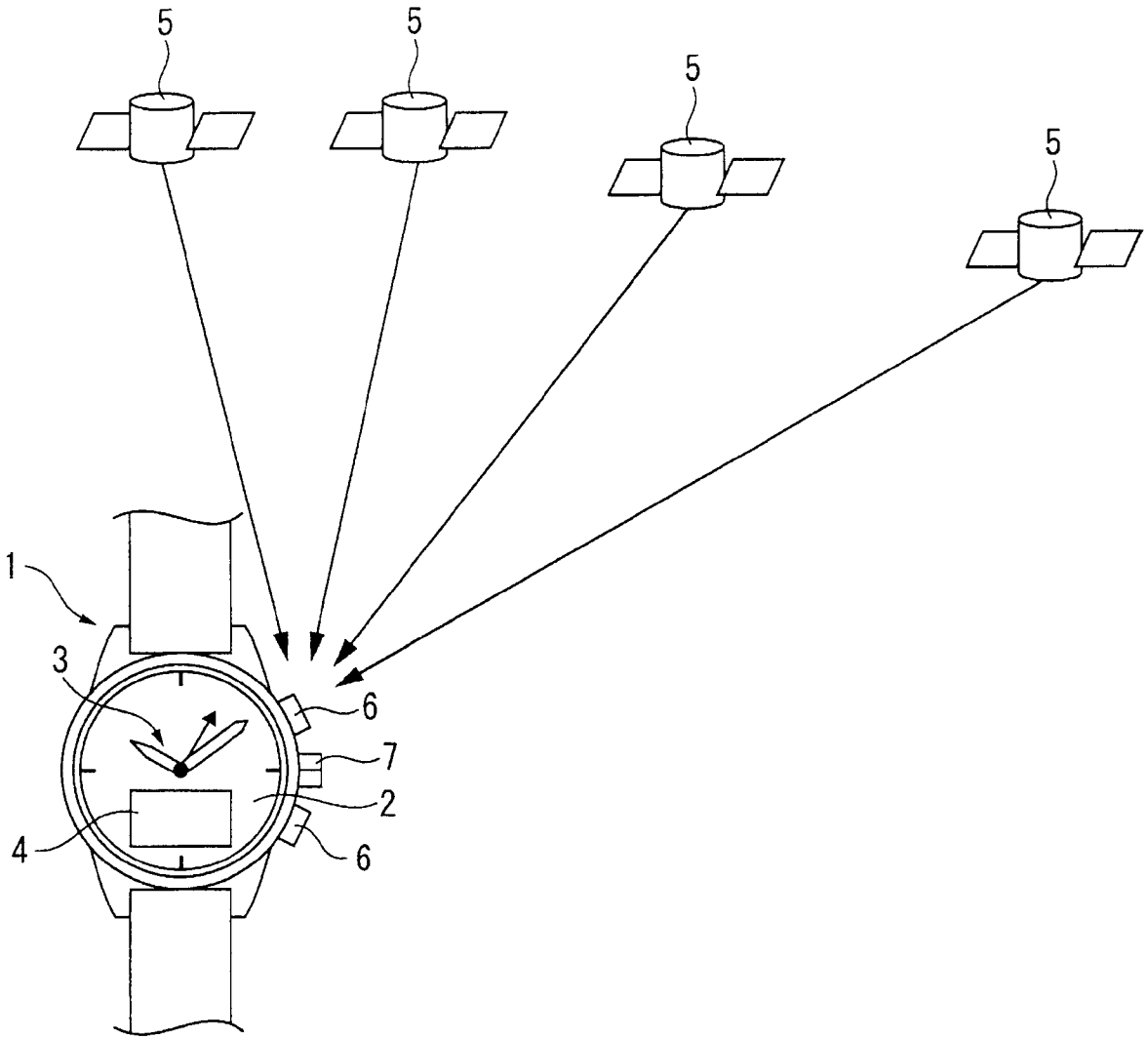
FIG. 1 shows a GPS wristwatch according to a preferred embodiment of the invention.

FIG. 1 shows a wristwatch with a GPS satellite signal reception device 1 (referred to as a GPS wristwatch 1 herein) as an example of a timepiece according to the invention.

As shown in FIG. 1, the GPS wristwatch 1 has a time display unit including a dial 2 and hands 3. A window is formed in part of the dial 2, and a display 4 such as an LCD panel is disposed therein. The GPS wristwatch 1 is thus a combination timepiece having both hands 3 and a display 4.

The hands 3 include a second hand, minute hand, and hour hand, for example, and are driven by a stepping motor through a wheel train.

The display 4 is rendered by an LCD panel, for example, and in addition to time difference data as described below can display the current time, messages, and other information.

The GPS wristwatch 1 is configured to receive satellite signals and acquire satellite time information from a plurality of GPS satellites 5 orbiting the Earth on known orbits in space, and can correct the internal time information and display positioning information, that is, the current location, on the display 4.

Note that the GPS satellite 5 is an example of a positioning information satellites in the invention, and a plurality of GPS satellites 5 orbit the Earth in space. There are currently approximately 30 GPS satellites 5 in orbit.

Buttons 6 and a crown 7 are disposed to the GPS wristwatch 1 as input devices (external operating members).

*Circuit Design of the GPS Wristwatch

The circuit design of the GPS wristwatch 1 is described next.

Figure 2:
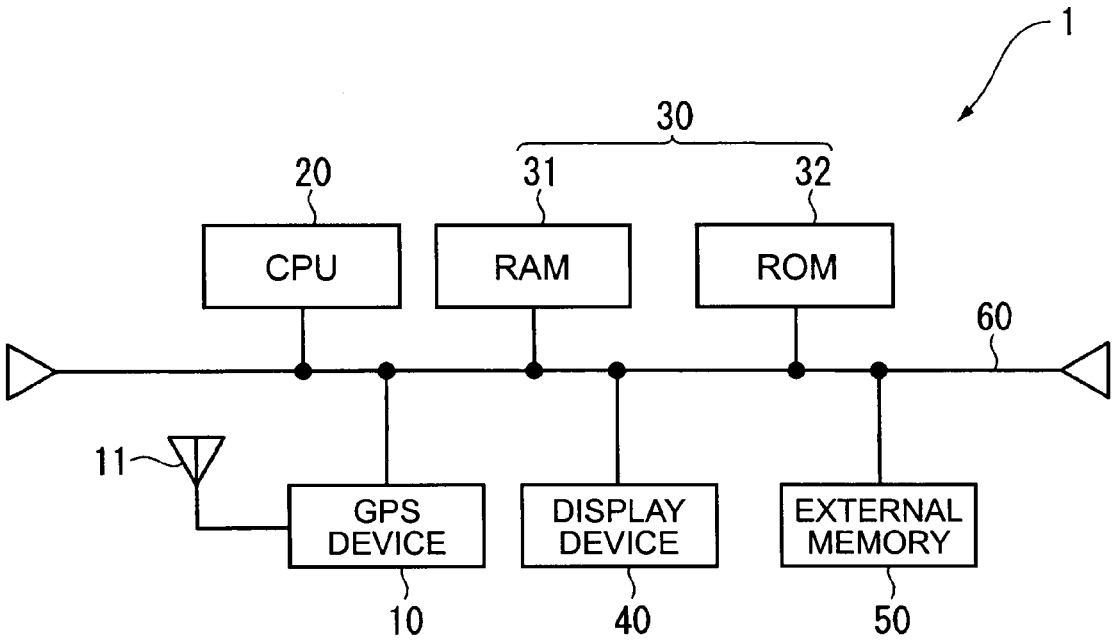
FIG. 2 is a circuit block diagram of the GPS wristwatch according to a preferred embodiment of the invention.

As shown in FIG. 2, the GPS wristwatch 1 has a GPS device 10 (GPS module), a control device 20 (CPU), a storage device 30 (storage unit), a display device 40 (display unit), and external memory 50. The storage device 30 includes RAM 31 and ROM 32. Data is communicated between these different devices over a data bus 60, for example.

The display device 40 includes hands 3 and a display 4 for displaying the time and positioning information, and is controlled by the CPU 20. More specifically, the hands 3 are driven using a stepping motor and wheel train, and point to the internal time, which is corrected based on received time data. The display 4 displays information including time information and positioning information.

The power source for driving these other devices is a primary battery or storage cell. A storage cell may be charged using an electromagnetic induction contactless charging method, or using power produced by a solar panel disposed to part of the GPS wristwatch 1 dial 2.

*GPS Device Configuration

The GPS device 10 has a GPS antenna 11 and acquires time information and positioning information by processing satellite signals received through the GPS antenna 11.

The GPS antenna 11 is a patch antenna for receiving satellite signals from a plurality of GPS satellites 5 orbiting the Earth on fixed orbits in space. The GPS antenna 11 is located on the back side of the dial 12, and receives RF signals through the crystal and the dial 2 of the GPS wristwatch 1.

The dial 2 and crystal are therefore made from materials that pass RF signals such as the satellite signals transmitted from the GPS satellites 5. The dial 2, for example, is plastic.

Although not shown in the figures, the GPS device 10 includes an RF (radio frequency) unit that receives and converts satellite signals transmitted from the GPS satellites 5 to digital signals, a baseband unit that correlates the reception signal and synchronizes with the satellite, and a data acquisition unit that acquires the time information and positioning information from the navigation message (satellite signal) demodulated by the baseband unit, similarly to a common GPS device.

The RF unit includes bandpass filter, a PLL circuit, an IF filter, a VCO (voltage controlled oscillator), an A/D converter, a mixer, a low noise amplifier, and an IF amplifier.

The satellite signal extracted by the bandpass filter is amplified by the low noise amplifier, mixed by the mixer with the signal from the VCO, and down-converted to an IF (intermediate frequency) signal. The IF signal mixed by the mixer passes the IF amplifier and IF filter, and is converted to a digital signal by the A/D converter.

The baseband unit includes a local code generator and a correlation unit. The local code generator generates a local C/A code (also referred to as a "local code" herein) that is identical to the C/A code used for transmission by the GPS satellite 5. The correlation unit calculates the correlation between this local code and the reception signal output from the RF unit.

If the correlation calculated by the correlation unit is greater than or equal to a predetermined threshold value, the generated local code and the C/A code used in the received satellite signal match, and the satellite signal can be captured (that is, the receiver can synchronize with the satellite signal). The navigation message can thus be demodulated by applying this correlation process to the received satellite signal using the local code.

The data acquisition unit acquires the time information and positioning information from the navigation message demodulated by the baseband unit. More specifically, the navigation message transmitted from the GPS satellites 5 contains subframe data such as a preamble and the TOW (Time of Week, also called the Z count) carried in a HOW (handover word). The subframe data is divided into five subframes, subframe 1 to subframe 5, and the subframe data includes the week number, satellite correction data including the satellite health, the ephemeris (detailed orbital information for the particular GPS satellite 5), and the almanac (approximate orbit information for all GPS satellites 5 in the constellation).

The data acquisition unit extracts a specific part of the data from the received navigation message, and acquires the time information and positioning information. The GPS device 10 thus renders a reception unit in this embodiment of the invention.

*Storage Device and External Memory

A program executed by the CPU 20 is stored in ROM 32 in the storage device 30. Time difference data, and time information and positioning information acquired by signal reception, are stored in RAM 31 in the storage device 30.

Figure 3:
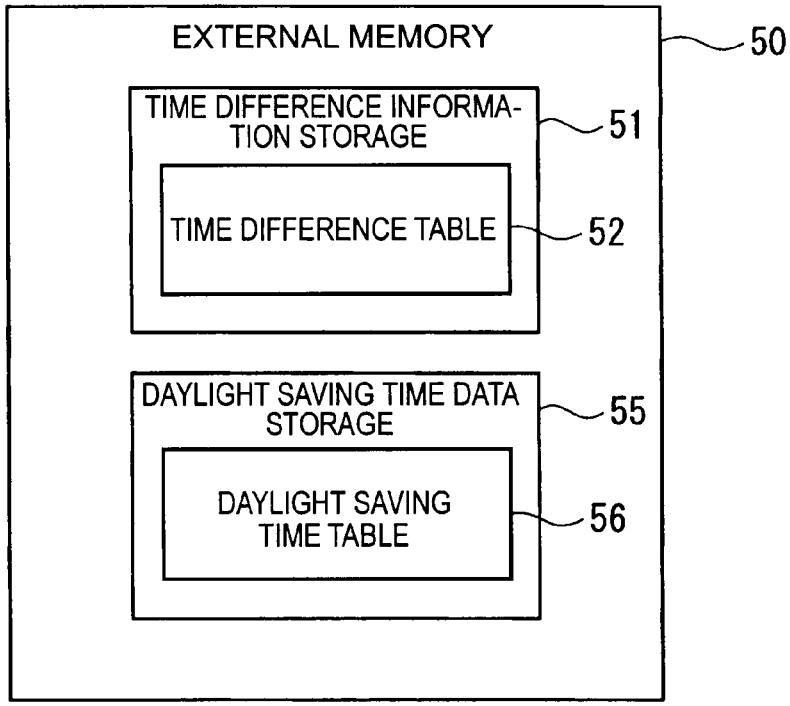
FIG. 3 is a block diagram of the external memory in a preferred embodiment of the invention.

As shown in FIG. 3, the external memory 50 functions as a time difference information storage unit 51 and a daylight saving time data storage unit 55. As described below, a time difference table 52 is stored in the time difference information storage unit 51. The daylight saving time data storage unit 55 functions as a specific date data storage and stores a daylight saving time table 56. Note that because the external memory 50 is rewritable, the data stored in tables 52 and 56 can be updated.

*Control Device Configuration

Figure 4:
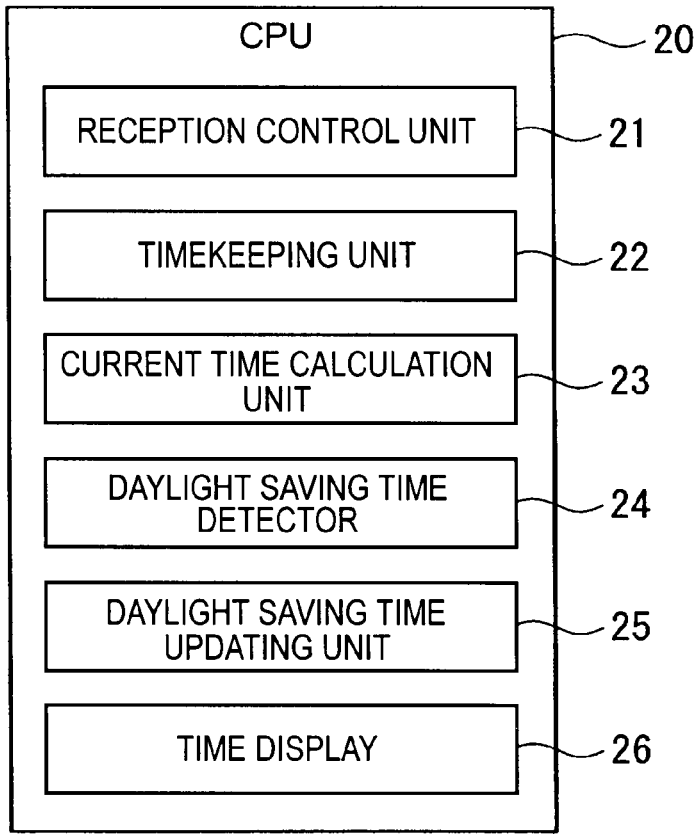
FIG. 4 is a block diagram showing the configuration of the control device in a preferred embodiment of the invention.

The control device 20 (CPU) controls operation by running a program stored in ROM 32. As a result, as shown in FIG. 4, the control device 20 has a reception control unit 21, a timekeeping unit 22, a current time calculation unit 23, a daylight saving time detector 24, a daylight saving time updating unit 25, and a time display 26.

The reception control unit 21 drives the GPS device 10 to execute a satellite signal reception process when, for example, reception is forced by the user operating an input device such as one of the buttons 6 or the crown 7, or when a preset reception time is set and the reception time has come.

The timekeeping unit 22 updates the internal time and keeps the current time using a reference signal from a reference signal generator (oscillation circuit) such as a crystal oscillator not shown.

Based on positioning information (latitude and longitude) acquired by the GPS device 10, the current time calculation unit 23 acquires time difference data for the current location using the time difference table 52 stored in external memory 50, and calculates the current time at the current location based on the time information acquired by the GPS device 10 (GPS time+leap seconds) and the acquired time difference data.

The current time calculation unit 23 then updates the internal time kept by the timekeeping unit 22 to the calculated current time. As a result, the time kept by the timekeeping unit 22 is automatically adjusted to the correct time based on the received data when a satellite signal is received.

The daylight saving time detector 24 determines if the current time calculated by the current time calculation unit 23 or kept by the timekeeping unit 22 is within the period when daylight saving time is in effect, referred to below as the daylight saving time period. The before/after specific weekday determination device of the invention is thus rendered by the daylight saving time detector 24.

When the daylight saving time detector 24 determines the current time is in the daylight saving time period, the daylight saving time updating unit 25 adds the daylight saving time adjustment to the current time and updates the current time to the current daylight saving time.

The time display 26 normally displays the internal time kept according to the reference signal using the hands 3. The time display 26 can also display the internal time digitally on the display 4.

Note that because the internal time is adjusted according to the calculated time when the current time calculation unit 23 calculates the time, the time display 26 also displays the corrected time. The time display 26 can thereafter continue displaying the correct time because the corrected internal time is updated according to the reference signal.

Yet further, when the current time is updated to daylight saving time by the daylight saving time updating unit 25, the time display 26 displays the updated daylight saving time using the hands 3 and/or display 4.

*Daylight Saving Time Evaluation Device

Figure 5:
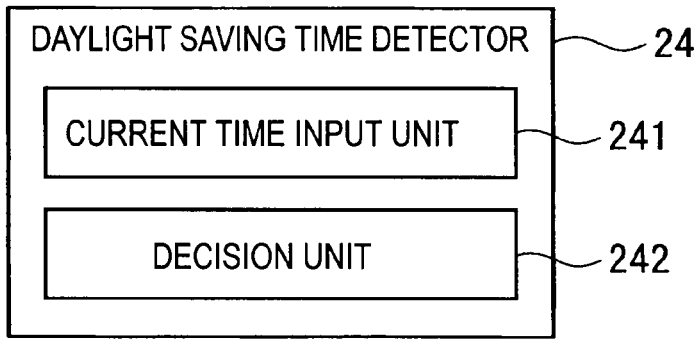
FIG. 5 is a block diagram showing the configuration of the daylight saving time detector in a preferred embodiment of the invention.

The daylight saving time evaluation device (detector) 24 has a current time input unit 241 and a decision unit 242 as shown in FIG. 5.

The current time input unit 241 inputs information for the current time used as the evaluation date to the daylight saving time detector 24. An evaluation date input unit is thus rendered by the current time input unit 241.

Because the daylight saving time period is normally evaluated based on the time at the current location, the time at the current location calculated by the current time calculation unit 23 and kept by the timekeeping unit 22 is input as the current time.

Even if the displayed time is the current daylight saving time updated by the daylight saving time updating unit 25 when the time at the current location is input, the current time input unit 241 input the time at the current location before it is updated to daylight saving time, that is, inputs the UTC time corrected for the standard time difference.

Using the current time input by the current time input unit 241 and the data stored in the daylight saving time table 56, the decision unit 242 determines whether or not the current time is a time in the daylight saving time period, that is, daylight saving time is in effect. The specific decision process is described in detail below.

*Data Structure of the Time Difference Table

FIG. 6 shows the data structure of the time difference table 52.

The time difference is the difference between the local time in a particular country or region and the Coordinated Universal Time (UTC), and is therefore theoretically set according to longitude. However, the boundaries of the time zones that are actually used are often national borders. In addition, daylight saving time (summer time) is normally individually controlled by each country, and some countries have both regions where daylight saving time is used and regions where daylight saving time is not used.

As a result, as shown in FIG. 6, the time difference table 52 stores information including country name, time zone, time zone location information, time difference, and a daylight saving time number. Note that the data that is actually required by the CPU 20 for processing is the location information, time difference, and daylight saving time number. The country and time zone information is provided so that the relationship between each country and the location information, time difference, and daylight saving time number, is easier to understand. As a result, the time difference table 52 may contain only the location information, time difference, and daylight saving time number.

The country name is stored in the country field of the time difference table 52. The standard time in that country is stored in the time zone field, and the time difference to UTC is stored in the time difference field.

For example, England, Ireland, and Portugal are in the Western European time zone where the time is the same as UTC (UTC+0), while France and Germany are on Central European time (UTC+1).

Location information describing the borders of that country or time zone is stored in the location information field. This information enables determining in which country or time zone the positioning information acquired by the GPS device 10 is located, such as data describing the borders of each country or time zone.

The daylight saving time number is a number identifying the daylight saving time information in the country or time zone identified by the location information. These daylight saving time numbers correspond to the daylight saving time numbers of the daylight saving time table 56 shown in FIG. 7.

*Data Structure of the Daylight Saving Time Table

The data structure of the daylight saving time table 56 is described next with reference to FIG. 7.

The daylight saving time table 56 stores the daylight saving time number, the starting time and ending time of the daylight saving time (summer time) period, the time adjustment, and applicable conditions.

A daylight saving time number of 0 in the daylight saving time table 56 denotes a location where daylight saving time is not used. As a result, start and end time data is not stored, and the adjustment is 0 hours.

The daylight saving time number is therefore set to 0 in the time difference table 52 for regions where daylight saving time is not used, such as Japan.

The start time and end time in the daylight saving time table 56 are stored in the following format: a number M0 denoting the month, numbers DS denoting candidate starting dates or numbers DE denoting candidate ending dates, weekday DW0, and hour/minute Hm0.

For example, daylight saving time information for countries, such as England, that use Western European time is stored with daylight saving time number 1 in the daylight saving time table 56. In England daylight saving time is in effect when the local time is between 1:00 a.m. on the last Sunday in March and 1:00 a.m. on the last Sunday in October. In other words, when the local time in England reaches 1:00 a.m. on the last Sunday in March, the time advances to 2:00 a.m. on the same day (British Summer Time). When the time then goes to 2:00 a.m on the last Sunday in October (BST), the time reverts to 1:00 a.m of the same day. As a result, 1:00 a.m. on the last Sunday in October, which is the time that British Summer Time ends is the local time uncorrected for daylight saving time.

The dates (candidate dates) that could be the last Sunday in March or October are the 25th to the 31st.

As a result, (3, 25, 31, Sunday, 01:00) is stored as the starting time data for daylight saving time number=1 is therefore. The end time data for daylight saving time number=1 is (10, 25, 31, Sunday, 01:00).

daylight saving time information for France and other countries that use Central European Time is stored for daylight saving time number=2 in the daylight saving time table 56. Because the time difference from Western European time to Central European Time is +1 hour, daylight saving time is when the local time is between 2:00 a.m on the last Sunday in March and 2:00 a.m on the last Sunday in October.

As a result, (3, 25, 31, Sunday, 02:00) is stored as the starting time information for daylight saving time number=2, and (10, 25, 31, Sunday, 02:00) is stored as the end time for daylight saving time number=2.

Daylight saving time information used in the United States is stored for daylight saving time number=5 in the daylight saving time table 56. In the United States daylight saving time is in effect from a local standard time of 2:00 a.m on the second Sunday in March to 1:00 a.m on the first Sunday in November. More specifically, in the United States the time changes to 3:00 a.m. (daylight saving time) when the current local time becomes 2:00 a.m on the second Sunday in March. When the time reaches 2:00 a.m (daylight saving time) on the first Sunday in November, the time reverts to 1:00 a.m. As a result, 1:00 a.m on the first Sunday in November, which is the end of daylight saving time, is the local time that is not adjusted for daylight saving time.

The dates (candidate dates) that could be the second Sunday in March are from the 8th to the 14th. Candidate dates for the first Sunday in November are from the 1st to the 7th.

As a result, (3, 8, 14, Sunday, 02:00) is stored as the start time data for daylight saving time number=5, and (11, 1, 7, Sunday, 01:00) is stored as the end time data for daylight saving time number=5.

The time by which the standard time is adjusted to get daylight saving time (normally +1 hour) is stored in the daylight saving time adjustment field of the daylight saving time table 56.

Conditions for determining whether or not daylight saving time is in effect in the period between the foregoing start time and end time is stored in the applicable conditions field.

More specifically, of the times for switching between daylight saving time and standard time, the dates that come first between January and December are stored in the start time of the time difference table 52, and the dates that come last are stored in the end time.

As a result, while daylight saving time in the southern hemisphere is from October to April, for example, the time in April for switching from daylight saving time to standard time is stored in the start time in time difference table 52, and the time in October for changing from standard time to daylight saving time is stored as the end time.

For example, daylight saving time information used in Sydney, Australia (New South Wales) is stored for daylight saving time number=4 in the daylight saving time table 56. In Sydney daylight saving time is in effect from a local standard time of 2:00 a.m. on the first Sunday in October to 2:00 a.m. on the first Sunday in April. More specifically, when the local time in Sydney becomes 2:00 a.m. on the first Sunday in October, the time changes to 3:00 a.m. (daylight saving time) of the same day. When the time goes to 3:00 a.m. (daylight saving time) on the first Sunday in April, the time reverts to 2:00 a.m. As a result, 2:00 a.m. on the first Sunday in April when daylight saving time ends is expressed as the local time unadjusted for daylight saving time.

Dates (candidate dates) that could be first Sunday in April are the 1st to 7th. Candidate dates for the first Sunday in October are also the 1st to 7th.

As a result, (4, 1, 7, Sunday, 02:00) is stored as the start time (actually the time for changing from daylight saving time to standard time) for daylight saving time number=4. In addition, (10, 1, 7, Sunday, 02:00) is stored as the end time for daylight saving time number=4 (actually the time for changing from standard time to daylight saving time).

When the apply condition=0 in this embodiment of the invention, from the start time to the end time is the period when daylight saving time is in effect, and when the apply condition=1, from the start time to the end time is the period when daylight saving time is not in effect.

Note that October could be set as the start time and April could be set as the end time. However, as described below, to make determining whether or not the current date and time are within the foregoing ranges easier, setting the smaller month as the start time makes the time comparison easier. Therefore, by setting the apply condition to 1 when the month of the start time is greater than the month of the end time, and handling the period from the month of the start time to the month of the end time as the period when daylight saving time is not in effect, the same process can be used in the northern hemisphere by setting the apply condition to 0 and in the southern hemisphere by setting the apply condition to 1.

*Regions where Daylight Saving Time is Set by Date

There are also regions where daylight saving time is set by a fixed date. In this situation the same date can be set for the start candidate date and end candidate date.

For example, daylight saving time number=3 shows the values for a region where daylight saving time starts at 22:00 on 3/27 and ends at 23:00 on 9/27 (local time). These times are also expressed as the local time unadjusted for daylight saving time. Therefore, in a region identified by daylight saving time number=3, the time advances to 23:00 (daylight saving time) when the local standard time goes to 22:00 on 3/27, and reverts to 23:00 when the time goes to 24:00 on 9/27.

*Reception Process

The process whereby the timepiece according to this embodiment of the invention receives satellite signals and adjusts the time is described next.

*Positioning Process

The GPS wristwatch 1 requires time difference information in order to adjust the UTC acquired from the received satellite signal to the current local time.

A positioning process is therefore executed if this time difference information is not stored in RAM 31 after the timepiece 1 is initialized, for example.

The positioning process is also executed when the user manually initiates positioning information reception. This is because when the user travels abroad or moves to a different time zone, the time must be adjusted to the current local time.

Similarly to a common GPS receiver, the reception control unit 21 captures and receives satellite signals from three or more satellites, executes the positioning process, and acquires the latitude, longitude, and GPS time for the current location of the timepiece 1.

Next, the current time calculation unit 23 compares the acquired positioning information with the location information in the time difference table 52, searches for an area in which the acquired positioning information is located, and stores the time difference information in RAM 31.

The current time calculation unit 23 also adds the leap seconds to the acquired GPS time to get the UTC, and then adds the time difference to get the current local time.

There are also situations in which the time difference information is already stored in RAM 31 and the positioning process is not necessary. In this situation the reception control unit 21 captures and receives satellite signals from at least one satellite to get the GPS time. The current time calculation unit 23 then adds the leap seconds to the acquired GPS time to get the UTC, and then adds the time difference to get the current local time.

Figure 8:
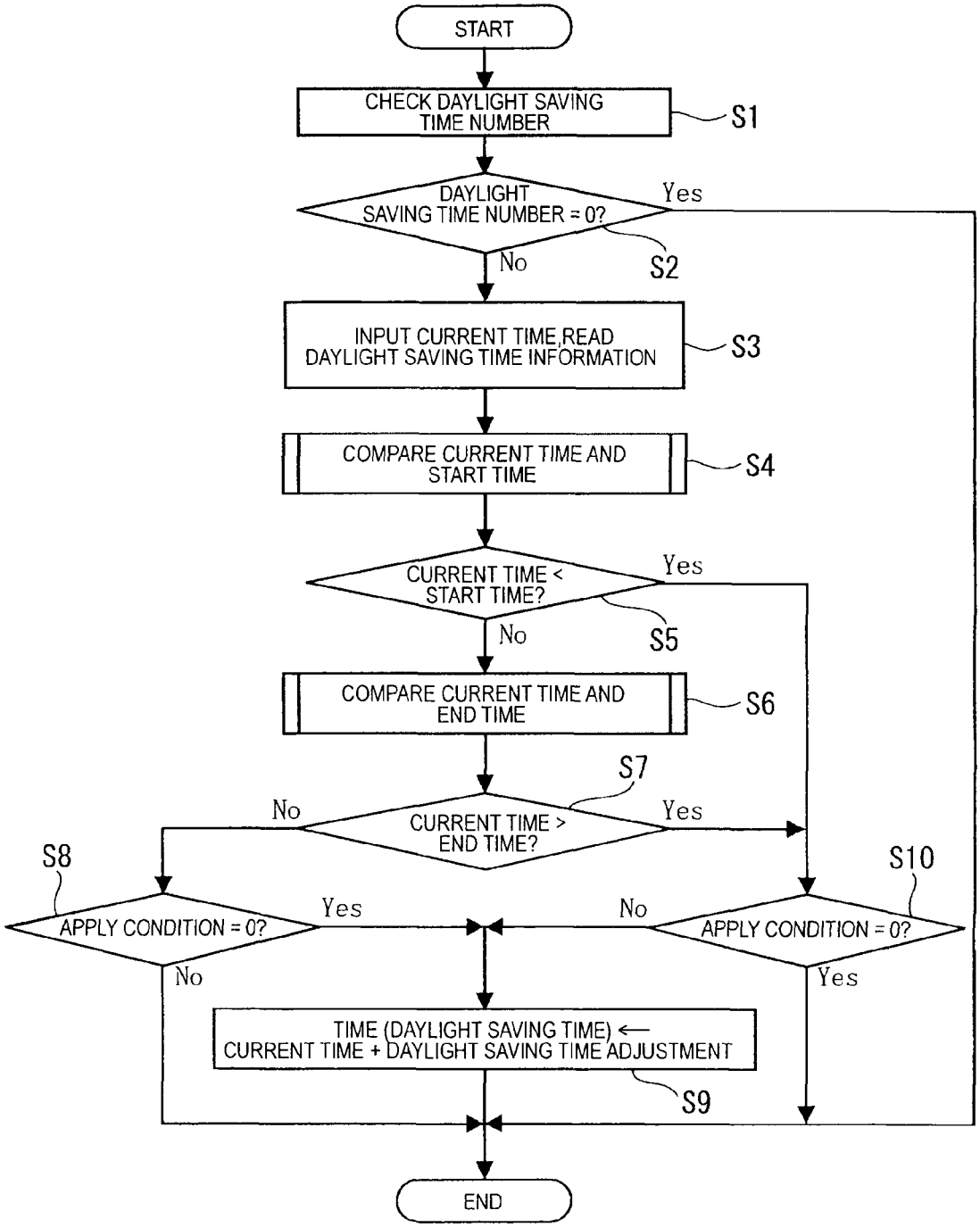
FIG. 8 is a flow chart showing steps in the daylight saving time update process in a preferred embodiment of the invention.

If the time difference information and time information (current local time) can be acquired, the daylight saving time detector 24 then executes a daylight saving time evaluation process shown as shown in the flow chart in FIG. 8.

When the daylight saving time evaluation process starts, the daylight saving time detector 24 first refers to the daylight saving time number for the corresponding region in the time difference table 52 (S1).

The daylight saving time detector 24 then determines if the daylight saving time number=0 (S2). If the daylight saving time number=0, such as for Japan, daylight saving time is not used and the daylight saving time evaluation process ends. In this situation the internal time is adjusted to the current local time obtained by the current time calculation unit 23, and the time displayed by the hands 3, for example, is adjusted to the current local time.

If the daylight saving time number of the current location is not 0, the current time input unit 241 takes the current local time obtained by the current time calculation unit 23 (the time equal to UTC plus the time difference, that is, the time not corrected for daylight saving time) as input and reads the daylight saving time information for the same number from the daylight saving time table 56 (S3).

For example, if it is determined as a result of the positioning process using the received satellite signals that the current location is New York in the United States, or if the user manually sets the time difference to the Eastern time zone in the United States, the American Eastern Standard Time is selected in the time difference table 52 and the corresponding daylight saving time number is 5.

As a result, the current time input unit 241 reads the current local time and the data (including the start time, end time, adjustment amount, apply condition) for daylight saving time number=5 from the daylight saving time table 56.

*Time Comparison: Comparison with Start Time

Next, the decision unit 242 compares the time information T1 input to the current time input unit 241 with the start time read from the daylight saving time table 56 (S4). More specifically, the decision unit 242 executes the process shown in FIG. 9 to compare the current time with the standard time (start time and end time).

Figure 9:
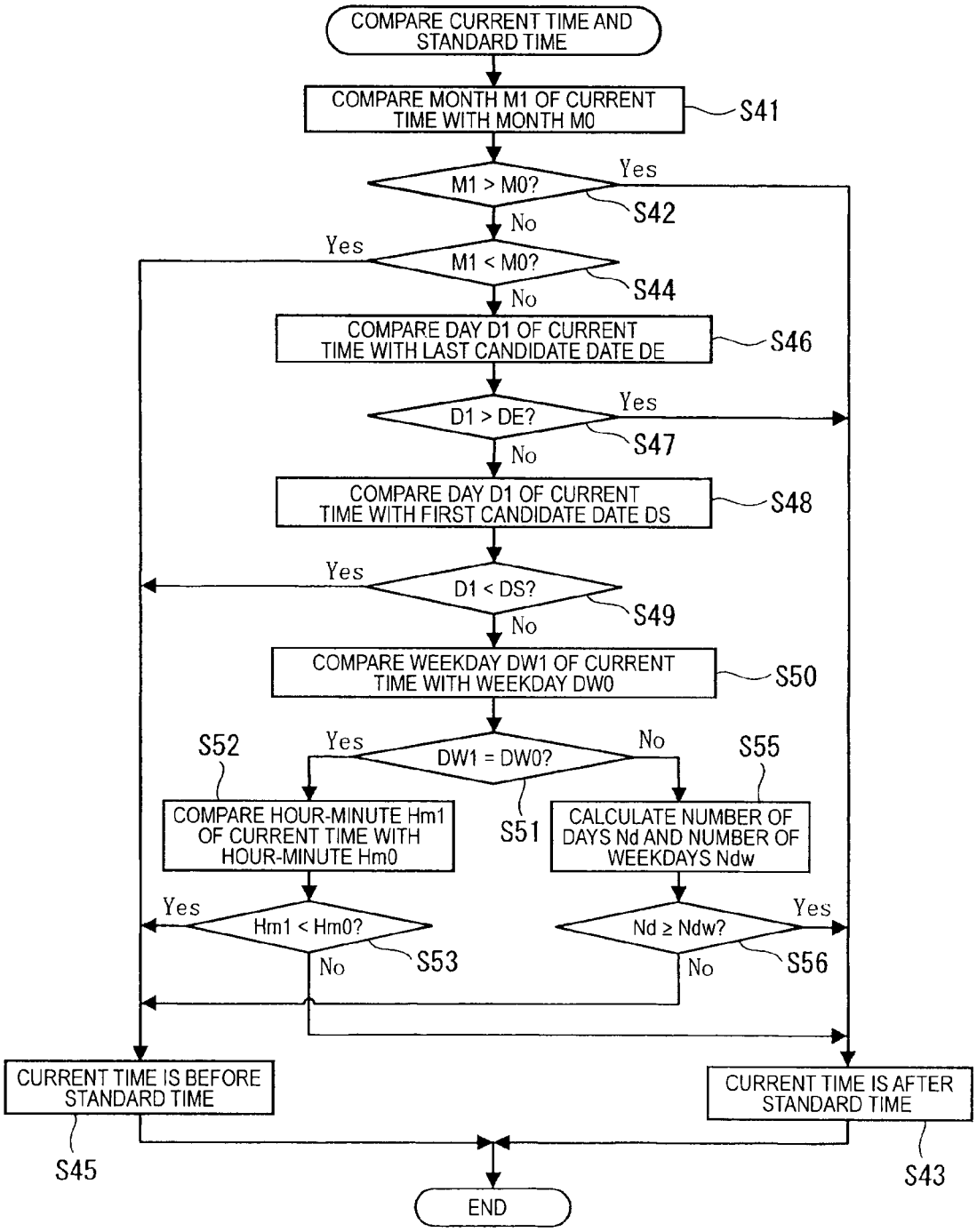
FIG. 9 is a flow chart showing the steps in the current time and standard time comparison process in a preferred embodiment of the invention.

Referring to FIG. 9, the decision unit 242 first compares month M1 of current time T1 with month M0 of the daylight saving time start time (S41).

Next, decision unit 242 determines if M1>M0 (S42). If S42 returns yes, current time T1 is after the daylight saving time start time (after the standard time) (S43). For example, if month M0=March, and M1=April or February, the current time T1 is after the daylight saving time start time.

If S42 returns No, the decision unit 242 determines if M1<M0 (S44). If S44 returns Yes, the current time T1 is before the daylight saving time start time (S45). For example, if month M0=March, and M1=January or February, the current time T1 is before the daylight saving time start time.

If S44 returns no, that is, if month M1=M0, the decision unit 242 compares day D1 of current time T1 with the last candidate date DE of the daylight saving time start time (S46).

Decision unit 242 then determines if D1>DE (S47). If S47 returns yes, the current time T1 is after the daylight saving time start time (S43). For example, if day D1 of the current time T1 is 15, and the last candidate date DE is 14, D1>DE and the current time T1 is after the daylight saving time start time.

However, if S47 returns no, that is, if D1≤DE, decision unit 242 compares day D1 of current time T1 with the first candidate date DS of the daylight saving time start time (S48). The decision unit 242 then determines if D1<DS (S49). If S49 returns Yes, current time T1 is before the daylight saving time start time (S45). For example, if day D1 of current time T1 is 5 and the first candidate date DS is 8, D1<DS, and current time T1 is before the daylight saving time start time.

If S49 returns no, DS≤D1≤DE. That is, day D1 of current time T1 is within the period from daylight saving time first candidate date DS to last candidate date DE.

In this situation the decision unit 242 compares weekday DW1 of day D1 of current time T1 with weekday DW0 of the daylight saving time start time (S50).

The decision unit 242 then decides if DW1=DW0 (S51). If the weekday DW1 of the current time T1 matches the weekday DW0 of the daylight saving time start time, the decision unit 242 compares the hour-minute Hm1 of the current time T1 with the hour-minute Hm0 of the daylight saving time start time (S52).

The decision unit 242 then determines if Hm1<Hm0 (S53). If S53 returns Yes, that is, the hour-minute Hm1 of the current time T1 is before hour-minute Hm0 of the daylight saving time start time, the decision unit 242 determines it is before the start of daylight saving time (S45). However, if S53 returns No, that is, the hour-minute Hm1 of the current time T1 is after hour-minute Hm0 of the daylight saving time start time, the decision unit 242 determines it is after the start of daylight saving time (S43).

If S51 returns No, and the weekday DW1 of day D1 of current time T1 differs from the weekday DW0 of the daylight saving time start time, the decision unit 242 calculates the number of days Nd and the number of weekdays Ndw (S55), and determines if Nd≥Ndw (S56).

More specifically, the decision unit 242 determines the number of days Nd from the first candidate date DS of the daylight saving time start time to the current time T1, and the number of weekdays Ndw from weekday DW0 of the daylight saving time start time to weekday DW1 of the current time T1.

The decision unit 242 then determines if Nd≥Ndw (S56), and if Yes, that is, the number of days Nd is greater than or equal to the number of weekdays Ndw, determines that the current time T1 is after the first day of daylight saving time (S43). If No, that is, the number of days Nd is less than the number of weekdays Ndw, the decision unit 242 determines the current time T1 is before the first day of daylight saving time (S45).

For example, let the first day of daylight saving time be the second Sunday in March, and the current time T1 be 3/10 (Monday). In this situation, because the first daylight saving time candidate date is 3/8, the number of days from the first daylight saving time candidate date to current time T1 is 10−8=2.

In addition, the number of weekdays from the weekday (Sunday) of the start of daylight saving time to the weekday (Monday) of the current time T1 is Monday−Sunday=1.

Because the number of days (2) is greater than the number of weekdays (1), the current time T1 is after the first day of daylight saving time. More specifically, if the current time T1 is 3/10 (Monday), that it is after the first day of daylight saving time can be confirmed because the second Sunday in March is 3/9 (Sunday).

corresponding date is before the reference date, and A represents that the corresponding date is after the reference date.

For example, if the second Sunday in March is the reference date and 3/9 is a Monday, it is A: after the reference date Monday, and if 3/8 is a Tuesday, it is B: before the reference date.

TABLE 1

| | | Weekday number | | | | | | |
|---|---|---|---|---|---|---|---|---|
| Day no. | Weekday | 0 Sunday | 1 Monday | 2 Tuesday | 3 Wednesday | 4 Thursday | 5 Friday | 6 Saturday |
| 0 | 3/8 | — | B | B | B | B | B | B |
| 1 | 3/9 | — | A | B | B | B | B | B |
| 2 | 3/10 | — | A | A | B | B | B | B |
| 3 | 3/11 | — | A | A | A | B | B | B |
| 4 | 3/12 | — | A | A | A | A | B | B |
| 5 | 3/13 | — | A | A | A | A | A | B |
| 6 | 3/14 | — | A | A | A | A | A | A |

In addition, let the first day of daylight saving time be the second Sunday in March, and current time T1 be 3/10 (Monday). Because the first daylight saving time candidate date in this situation is 3/8, the number of days from the first daylight saving time candidate date to the current time T1 is 10−8=2.

In addition, the number of weekdays from the weekday of the daylight saving time start time (Sunday) to the weekday of the current time T1 (Wednesday) is Wednesday−Sunday=3.

Therefore, because the number of days (2) is smaller than the number of weekdays 3, the current time T1 is before the first day of daylight saving time. More specifically, if the current time T1 is 3/10 (Wednesday), that it is before the first day of daylight saving time can be confirmed because the second Sunday in March is 3/14 (Sunday).

Yet further, let the first day of daylight saving time be the second Sunday in March and the current time T1 be 3/10 (Tuesday). In this situation the first daylight saving time candidate date is 3/8, and the number of days from the first daylight saving time candidate date to the current time T1 is 10−8=2.

In addition, the number of weekdays from the weekday of the start of daylight saving time (Sunday) to the weekday (Tuesday) of the current time T1 is Tuesday−Sunday=2.

Therefore, because the number of days (2) is greater than or equal to the number of weekdays (2), the current time T1 is after the first day of daylight saving time. More specifically, if the current time T1 is 3/10 (Tuesday), it is after the first day of daylight saving time because the second Sunday in March is 3/8 (Sunday).

This correlation is summarized in Table 1. Note that in Table 1 and the following Table 2, B represents that the

*Comparing Time: Comparison with the End Time

When comparison of the current time T1 with the start time is completed in S4, the decision unit 242 determines if the current time T1 is before the start time (current time<start time) (S5).

If S5 returns No), that is, the current time T1 is determined to be equal to or after the start time in S5, the decision unit 242 compares the current time T1 with the end time (S6).

The method of comparison used in step S6 is the same as the comparison method of step S4 described with reference to the flow chart in FIG. 9 except for the substitution of end time data for the month M0, first candidate date DS, last candidate date DE, weekday DW0, and hour-minute Hm0, and further description thereof is thus omitted.

Note that Table 2 shows the results of the comparison when the current time T1 is between the first candidate date DS and the last candidate date DE of the end time and the daylight saving time end time is the last Sunday in October.

TABLE 2

| | | Weekday number | | | | | | |
|---|---|---|---|---|---|---|---|---|
| Day no. | Weekday | 0 Sunday | 1 Monday | 2 Tuesday | 3 Wednesday | 4 Thursday | 5 Friday | 6 Saturday |
| 0 | 10/25 | — | B | B | B | B | B | B |
| 1 | 10/26 | — | A | B | B | B | B | B |
| 2 | 10/27 | — | A | A | B | B | B | B |
| 3 | 10/28 | — | A | A | A | B | B | B |
| 4 | 10/29 | — | A | A | A | A | B | B |
| 5 | 10/30 | — | A | A | A | A | A | B |
| 6 | 10/31 | — | A | A | A | A | A | A |

After comparison of the current time T1 and the end time is completed in S6, the decision unit 242 determines if the current time T1 is after the end time (current time>end time) (S7).

If S7 returns No, that is the current time T1 is determined to be equal to or before the end time in S7, the decision unit 242 references the daylight saving time table 56 to determine if the apply condition=0 (S8).

More specifically, if S5 and S7 return No, the current time T1 is between the start time and the end time of daylight saving time. If the apply condition=0, this period is while daylight saving time is in effect as described above.

If S8 returns Yes, the decision unit 242 determines that daylight saving time is currently in effect in the time zone in which the GPS wristwatch 1 is located.

In this situation the daylight saving time updating unit 25 adds the daylight saving time adjustment to the current time T1 and updates it to daylight saving time (S9).

However, if S8 returns no, the decision unit 242 determines that daylight saving time is not currently in effect in the time zone in which the GPS wristwatch 1 is located. As a result, the daylight saving time updating unit 25 does not update the time to daylight saving time.

When S5 returns Yes and the current time T1 is before the daylight saving time start time, and when S7 returns Yes and the current time T1 is after the end time of daylight saving time, the current time T1 is outside the period between the start and end times of daylight saving time.

In this situation the decision unit 242 references the daylight saving time table 56 and determines if the apply condition=0 (S10).

If S10 returns no, that is, if the apply condition=1, daylight saving time is in effect outside this period. As a result, the decision unit 242 determines that daylight saving time is currently in effect in the time zone in which the GPS wristwatch 1 is located.

In this situation the daylight saving time updating unit 25 adds the daylight saving time adjustment to the current time T1 and updates it to daylight saving time (S9).

If S10 returns yes, the decision unit 242 determines that daylight saving time is not currently in effect in the time zone in which the GPS wristwatch 1 is located. the decision unit 242 determines that daylight saving time is not currently in effect in the time zone in which the GPS wristwatch 1 is located. As a result, the daylight saving time updating unit 25 does not update the time to daylight saving time.

A GPS wristwatch 1 according to this embodiment of the invention can thus automatically determine if daylight saving time is currently in effect and update the time to daylight saving time appropriately.

The effect of this embodiment of the invention is described below.

To determine if the current time T1 is while daylight saving time is in effect, the current time T1 is compared with the start time and the end time of the daylight saving time period. As shown in the flow chart in FIG. 9, this decision process only compares the current time T1 with the start time and end time values, and does not need to execute any multiplication or division operations such as are needed when Zeller's congruence is used.

Yet further, the current time T1 can be compared with the daylight saving time start and end times identified by weekday values without using an internal calendar.

As a result, the process can be executed and the processing time can be shortened even in a GPS wristwatch 1 that does not have multiplication and division functions and has only limited processing capacity and memory capacity.

Furthermore, because the decision unit 242 can determine if daylight saving time is currently in effect, the daylight saving time updating unit 25 can automatically update the current time T1 to daylight saving time.

As a result, the GPS wristwatch 1 user does not need to manually adjust the time at the beginning and end of daylight saving time, and convenience is greatly improved.

More particularly, when moving to a different time zone, such as when traveling internationally, GPS satellite signals are received and the current location determined, the current time zone and time difference are determined, whether or not daylight saving time is used is determined from the daylight saving time number, and if daylight saving time is determined to be in effect based on comparison with the current time T1, the daylight saving time updating unit 25 can update the displayed time to daylight saving time. As a result, the user does not need to manually adjust the time with consideration for the time difference and daylight saving time, and convenience can be improved.

Yet further, by providing an apply condition field in the daylight saving time table 56, the current local time and a reference time (the start time and end time) can be compared using a process such as shown in the flow chart in FIG. 9 whether the current location is in the northern hemisphere or southern hemisphere, and the program can therefore be shortened and the size of the program can be reduced accordingly. The program can therefore easily incorporated into a GPS wristwatch 1 with limited memory capacity.

*Other Embodiments

The invention is not limited to the embodiment described above.

For example, the current time and start time are first compared in step S4, and the current time and end time are only compared in step S6 if the current time is equal to or after the start time as shown in FIG. 8 in the embodiment described above, but step S6 may be executed first and S4 executed only when the current time is equal to or before the end time.

Likewise in the process shown in FIG. 9, steps S48 and S49 may be executed first with steps S46 and S47 executed thereafter.

Yet further, M1=M0 may be tested before steps S42 and S44, and steps S46 and later executed if M1=M0.

More specifically, the conditions described in the accompanying claims must be checked when the current time is compared with the reference times (start time and end time), and the procedure for confirming said conditions is not limited to the method described in the foregoing embodiment.

Yet further, compatibility with daylight saving time in both the northern hemisphere and southern hemisphere is enabled by including apply condition in the daylight saving time table 56 in the embodiment described above. Such compatibility can also be assured if separate daylight saving time tables 56 are provided for the northern hemisphere and southern hemisphere by selecting the appropriate table, and the apply condition field can then be omitted.

The before/after specific weekday determination device of the invention described above is used for determining if daylight saving time is in effect in the foregoing embodiment, but can be used for other applications. More specifically, because the invention uses the weekday for evaluation, the invention can be used in a wide range of applications that need to determine if an evaluation date is before or after a specific day when comparison based on the date is not possible.

Note that because the before/after determination is based on comparing the hour and minute in addition to the date in the foregoing embodiment, steps S52 and S53 are executed after S51 returns Yes in the flow chart in FIG. 9. However, if the specific day and the evaluation date are compared by day unit, the process can be configured to eliminate steps S52 and S53 and determine that the days are the same when S51 returns Yes.

The method of the present invention and variations thereof disclosed herein can be implemented using non-transitory computer-readable media for carrying or having computer-executable instructions or data structures stored thereon. Such computer-readable media can be any available media that can be accessed by a processor of a general purpose or special purpose computer. By way of example, and not limitation, such computer-readable media can comprise RAM, ROM, EEPROM, CD-ROM or other optical disk storage, magnetic disk storage or other magnetic storage devices, or any other medium that can be used to carry or store program code in the form of computer-executable instructions or data structures and that can be accessed by a processor (e.g. a central processing unit such as CPU 20) of a general purpose or special purpose computer and thereby executed by the computer to perform the method of the present invention. Combinations of the above should also be included within the scope of computer-readable media.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A daylight saving time determination device, comprising:

an evaluation date input unit that inputs a number M1, a number D1, DW1, and Hm1, where M1 denotes the month of the evaluation date, D1 denotes the day of the evaluation date, DW1 denotes the weekday of the of D1, and Hm1 denotes the hour and minute of an evaluation time of D1;

a specific date data storage that stores a number M0, DW0, a number DS, a number DE, and Hm0, where M0 denotes the month of a specific date, DW0 denotes the weekday of the specific date, DS denotes a first candidate date of seven candidate dates that could be the specific date in M0, DE denotes an end candidate date that is the last candidate date of the seven candidate dates, and Hm0 denotes the hour and minute of an evaluation time of the specific date, the specific date is a start time denoting the start date of daylight savings time and an end time that is the later than the start time and denotes the end date of daylight savings time, the specific date data storage further storing a daylight saving time adjustment and an apply condition denoting if the period from the start time to the end time is when daylight saving time is in effect or not in effect; and a decision unit that compares the numbers input by the evaluation date input unit with the numbers stored in the specific date data storage and decides if the input evaluation date is before or after the specific date;

wherein the decision unit determines that the evaluation date is before the specific date when (1) M1 is less than M0, (2) M1 is equal to M0 and D1 is less than DS, (3) M1 is equal to M0, D1 is greater than or equal to DS and less than or equal to DE, DW1 and DW0 are different, and the number of days Nd from DS to D1 is less than the number of weekdays Ndw from DW0 to DW1, or (4) M1 is equal to M0, D1 is greater than or equal to DS and less than or equal to DE, DW1 and DW0 are equal, and Hm1 is before Hm0;

wherein the decision unit determines that the evaluation date is after the specific date when (5) M1 is greater than M0, (6) M1 is equal to M0 and D1 is greater than DE, (7) M1 is equal to M0, D1 is greater than or equal to DS and less than equal to DE, DW1 and DW0 are different, and the number of days Nd from DS to D1 is greater than or equal to the number of weekdays Ndw from DW0 to DW1, or (8) M1 is equal to M0, D1 is greater than or equal to DS and less than or equal to DE, DW1 and DW0 are equal, and Hm1 is after Hm1; and wherein the decision unit determines if the current time is before or after the start time using the current time as the evaluation date and the start time as the specific date, if, as a result of comparing the current time and the start time, the current time is determined to be after the start time, the decision unit determines if the current time is before or after the end time using the current time as the evaluation date and the end time as the specific date, if the current time is determined to be before the start time, or if the current time is determined to be after the end time, the decision unit determines that the current time is in the period when daylight saving time is in effect if the apply condition is that the period from the start time to the end time is when daylight saving time is not in effect, and if the current time is determined to be after the start time and the current time is determined to be before the end time, the decision unit determines that the current time is in the period when daylight saving time is in effect if the apply condition is that the period from the start time to the end time is when daylight saving time is in effect.

2. A timepiece comprising:

the daylight saving time determination device described in claim 1;

a timekeeping unit that keeps current time; and a daylight saving time updating unit that adjusts the current time by the daylight saving time adjustment and updates to daylight saving time when the daylight saving time determination device determines that the current time is in a period when daylight saving time is in effect.

3. The timepiece described in claim 2, further comprising:

a reception unit that can receive satellite signals transmitted from positioning information satellites and acquire positioning information and time information;

a time difference information storage unit that stores positioning information, time difference information for the positioning information, and daylight saving time pattern data corresponding to the positioning information; and a time adjustment unit that obtains the time at the current location using positioning information and time information received by the reception unit, and information stored in the time difference information storage unit, and adjusts the current time kept by the timekeeping unit;

wherein the specific date data storage stores the start time, end time, daylight saving time adjustment, and apply conditions linked to the daylight saving time pattern data, the time adjustment unit acquires time difference information for the positioning information from the time difference information storage unit, corrects the received time information by the time difference, acquires the time of the current location, and adjusts the current time kept by the timekeeping unit, and the daylight saving time updating unit determines using the daylight saving time determination unit if the current time is in a period when daylight saving time is in effect based on the current time adjusted by the time adjustment unit, and the start time, end time, daylight saving time adjustment, and apply condition identified by the daylight saving time pattern data in the specific date data storage when daylight saving time pattern data is stored for the received positioning information, and updates the current time to daylight saving time if daylight saving time is determined to be in effect at the current time.

* * * * *